United States Patent [19]

Lo

[11] Patent Number: 4,852,872

[45] Date of Patent: Aug. 1, 1989

[54] EXERCISE BICYCLE FOR EXERCISING ARMS AND LEGS

[76] Inventor: Peter K. Lo, P.O. Box 13-124, Taipei, Taiwan

[21] Appl. No.: 298,692

[22] Filed: Jan. 19, 1989

Related U.S. Application Data

[63] Continuation-in-part of Ser. No. 192,166, May 10, 1988, Pat. No. 4,824,102.

[51] Int. Cl.[4] ..... A63B 21/00

[52] U.S. Cl. ..... 272/73; 74/48

[58] Field of Search ..... 272/73, 71, 72, 97, 272/116, 131, 132; 128/25 R; 74/47, 48, 571, 49, 50

[56] References Cited

U.S. PATENT DOCUMENTS

| | | | |
|---|---|---|---|
| 254,082 | 2/1882 | Wiard | 74/47 |
| 326,247 | 9/1885 | Root | 272/73 X |
| 4,188,030 | 2/1980 | Hooper | 272/73 |
| 4,657,244 | 4/1987 | Ross | 272/73 |
| 4,705,269 | 11/1987 | DeBoer | 272/73 |

*Primary Examiner*—S. R. Crow

[57] ABSTRACT

An exercise bicycle has a wheel axle which is journalled on a frame. Two swing arms are secured to two opposite end portions of the wheel axle. Two hand operated swing levers are mounted pivotally on the frame at their lower ends. Each of the levers includes an upper lever portion, a lower lever portion, and two parallel rods interconnecting the upper and lower lever portions for defining a slide slot therebetween. Each of the swing arms has a crank pin member on which a sheave is sleeved rotatably. Each of the sheaves has an annular groove of a generally V-shaped cross-section which engages with the arcuated inner side portions of the rods so that the sheave can slide smoothly in the slide slot. A suspended wheel is sleeved rotatably on the wheel axle by a hub. A front pulley is sleeved rigidly on the hub and is connected to a rear pulley by a v-belt. The rear pulley can be indirectly rotated by a user's hands and/or feet.

4 Claims, 5 Drawing Sheets

EXERCISE BICYCLE FOR EXERCISING ARMS AND LEGS

CROSS-REFERENCE OF RELATED APPLICATION

This invention is a continuation-in-part of application Ser. No. 192,166, filed on May 10, 1988, U.S. Pat. No. 4,824,102.

BACKGROUND OF THE INVENTION

This invention relates to an exercise bicycle, and more particularly to one which has a suspended wheel, the suspended wheel being indirectly rotatable by hands and/or feet.

Although the exercise bicycle of Application Ser. No. 192,166 can offer a significant exercise effect to the user, it is noisy due to the fact that much noise exists between rotating sprockets and chains and between sliding rollers and swinging levers.

SUMMARY OF THE INVENTION

The main object of this invention is to provide an exercise bicycle for exercising arms and legs which can smooth the relative sliding movement between rollers and swing levers.

Another object of this invention is to provide an exercise bicycle for exercising the arms and legs which can reduce noise in comparison with the exercise bicycle of application Ser. No. 192,166.

According to this invention, an exercise bicycle has a wheel axle which is journalled on a frame. Two swing arms are secured to two opposite end portions of the wheel axle. Two hand operated swing levers are mounted pivotally on the frame at their lower ends. Each of the levers includes an upper lever portion, a lower lever portion, and two parallel rods interconnecting the upper and lower lever portions for defining a slide slot therebetween. Each of the swing arms has a crank pin member on which a sheave is sleeved rotatably. Each of the sheaves has an annular groove of a generally V-shaped cross-section which engages with the arcuated inner side portions of the rods so that the sheave can slide smoothly in the slide slot. Preferably, the sheaves are made of plastic, steel or nylon. A suspended wheel is sleeved rotatably on the wheel axle by a hub. A front pulley is sleeved rigidly on the hub and is connected to a rear pulley by a v-belt. The rear pulley can be indirectly driven by hands and/or feet. The v-belt may be made of polyurethane. To minimize the noise resulting from the engagement of two sprockets and a chain, a tensioning sprocket is biased by a spring to tension the chain.

BRIEF DESCRIPTION OF THE DRAWINGS

Other features and advantages of this invention will become apparent in the following detailed description of the preferred embodiments of this invention with reference to the accompanying drawings in which.

DETAILED DESCRIPTION OF THE PREFERRED EMBODIMENTS

Figure 1:
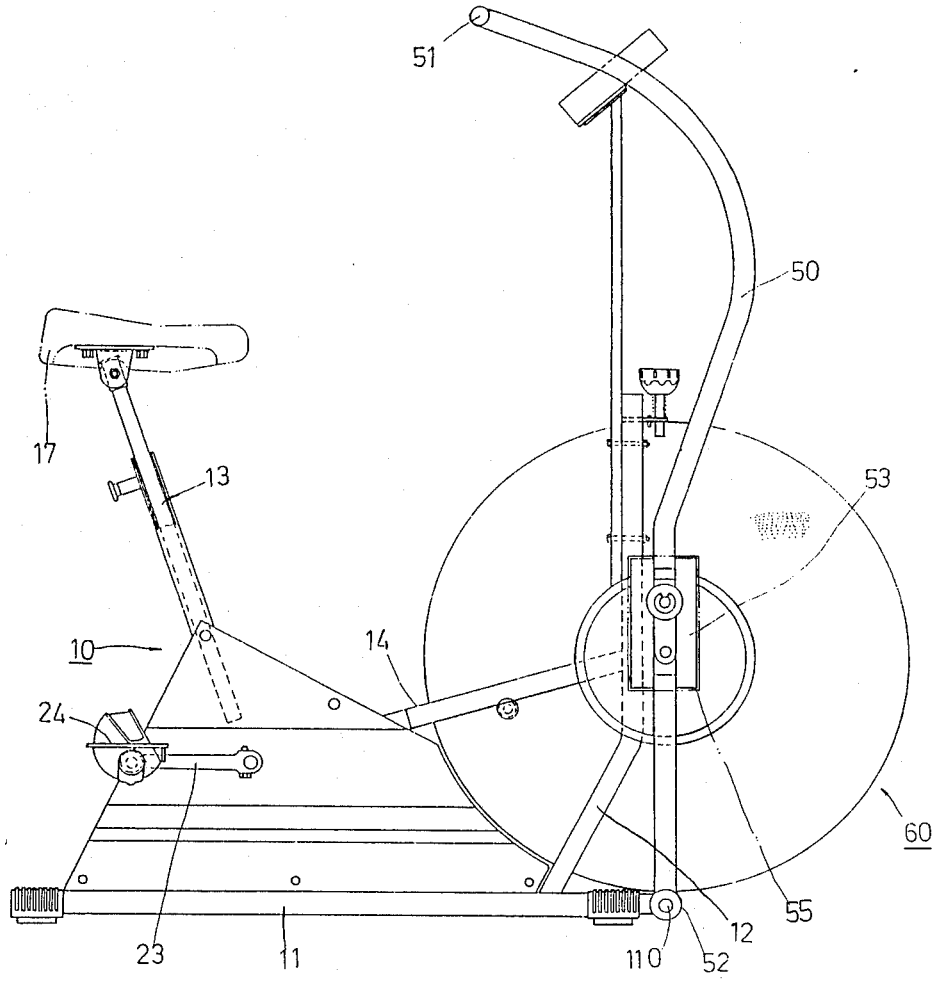
FIG. 1 is a schematic side view of an exercise bicycle according to this invention.
Figure 2:
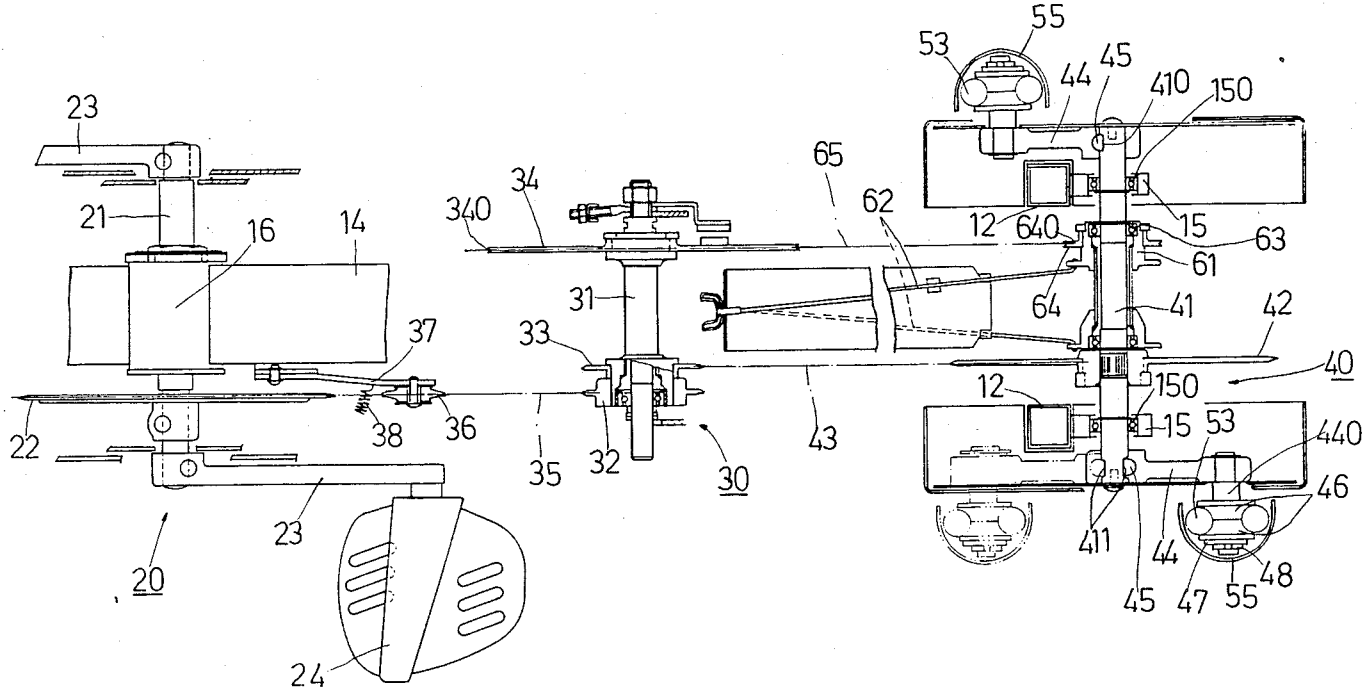
FIG. 2 is a schematic top view of the exercise bicycle according to this invention.

Referring to FIGS. 1 and 2, an exercise bicycle of this invention includes a frame assembly 10, a foot drive assembly 20, a driven shaft assembly 30, a wheel axle assembly 40, a swing lever assembly 50, and a driven wheel assembly 60.

The frame assembly 10 has a base frame 11 on which a driven wheel frame 12 and a seat frame 13 are fixed. The wheel frame 12 and the seat frame 13 are coupled by a strut 14. A front bearing block 15 is provided at the juncture between the wheel frame 12 and the strut 14. A rear bearing block 16 is provided at the juncture between the seat frame 13 and the strut 14. A saddle 17 is supported on the seat frame 13.

The foot drive assembly 20 includes a driving shaft 21 journalled on the bearings of the rear bearing block 16. The driving shaft 21 includes a rear driving sprocket 22 sleeved rigidly thereon, and two crank arms 23 secured to respective ends of the driving shaft 21. Each of the crank arms 23 carries a pedal 24 on the end thereof.

As shown more clearly in FIG. 2, the driven shaft assembly 30 includes a driven shaft 31 which is journalled on the middle of the base frame 11. The driven shaft 31 includes a foot driven sprocket 32 sleeved rotatably on the right portion thereof, a hand driven sprocket 33 sleeved rotatably on the middle portion of the driven shaft 31, and a rear pulley 34 sleeved rigidly on the driven shaft 31. A foot driven chain 35 is trained on the rear driving sprocket 22 and the foot driven sprocket 32. To minimize the noise resulting from the engagement of the chain 35 and the sprockets 22, 32, a tensioning sprocket 36 is mounted rotatably on the strut 14 by a connecting arm 37 and is biased by a spring 38 to tension the foot driven chain 35.

Figure 5:
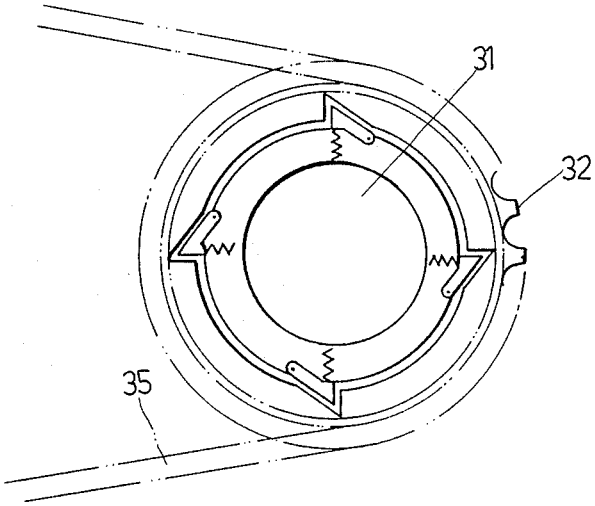
FIG. 5 is a schematic side view illustrating the connection between the driven shaft and the foot driven sprocket of the exercise bicycle in accordance with this invention.

Referring to FIG. 5, a first spring-biased ratchet mechanism is provided between the foot driven sprocket 32 and the driven shaft 31 in a known manner so that, when the foot driven sprocket 32 is rotated clockwise by stepping on the pedals 24, it is locked on the driven shaft 31 by the first ratchet mechanism and thus also rotates clockwise. When the foot driven sprocket 32 is rotated counterclockwise, the first ratchet mechanism is released to unlock the driven shaft 31 from the foot driven sprocket-32. With the first ratchet mechanism provided between the foot driven sprocket 32 and the driven shaft 31, the foot driven sprocket 32 can be driven by the driven shaft 31 only when the driven shaft 31 rotates counterclockwise. However, the driven shaft 31 cannot drive the foot driven sprocket 32 due to the fact that the driven shaft 31 never rotates counterclockwise, as described hereinafter.

Figure 6:
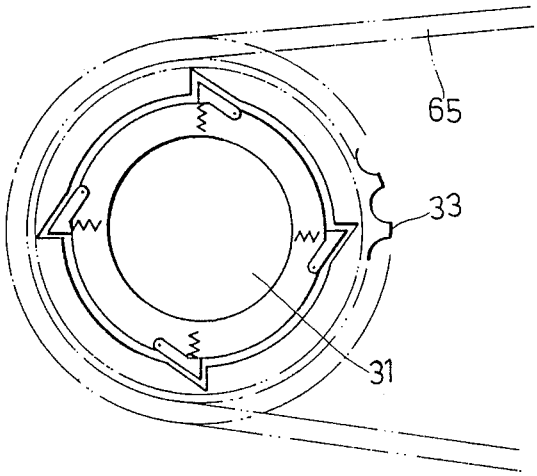
FIG. 6 is a schematic side view illustrating the connection between the driven shaft and the hand driven sprocket of the exercise bicycle in accordance with this invention.

Referring to FIG. 6, a second ratchet mechanism is provided between the hand driven sprocket 33 and the driven shaft 31 to perform the same function as the first ratchet mechanism. Therefore, both the foot driven sprocket 32 and the hand driven sprocket 33 act as the power input sprockets of the driven shaft 31. Because the rear pulley 34 is sleeved rigidly on the driven shaft 31, it can be driven by the same and can thus act as a power output pulley. As a result, because the driven shaft 31 can rotate only when either the foot driven sprocket 32 or the hand driven sprocket 33 is rotated clockwise, the driven shaft 31 can only rotate clockwise and cannot drive the foot driven sprocket 32 and/or the hand driven sprocket 33. As another result of providing these ratchet mechanisms, when a first torque is applied to the driven shaft 31 through the foot driven sprocket 32 and a second torque is applied to the driven shaft 31 through the hand driven sprocket 33, the sum of the first and second torques is output from the driven shaft 31 through the rear pulley 34.

The wheel axle assembly 40 includes a wheel axle 41 journalled on axle bearings 150 which are mounted within the front bearing block 15. A front driving sprocket 42 is sleeved rigidly on the wheel axle 41. A hand driven chain 43 is trained on the front driving sprocket 42 and the hand driven sprocket 33. Two swing arms 44 are sleeved on respective ends of the wheel axle 41. The wheel axle 41 has a left key-way 410 formed in its left end portion, and two opposed second key-ways 411 formed in the opposite sides of the right end portion of the wheel axle 41. The left swing arm 44 has a key 45 projecting therefrom to engage with the left key-way 410. The right swing arm 44 may be rotated relative to the wheel axle 41 to engage either of the right key-ways 411 with the key 45. Accordingly, the swing arms 44 may be freely adjusted to locate on opposite sides or the same side of the wheel axle 41. When the swing arms 44 are on opposite sides of the wheel axle 41, they can be swung by hand in opposite directions. When the swing arms 44 are on the same side of the wheel axle 41, they can be swung by hand in the same direction. The two manners in which the swing arms 44 are actuated can be selected according to the preference of the user. Because the swing arms 44 may be actuated in two manners, the exercise effect of the bicycle is increased. Each of the swing arms 44 includes a crank pin member 440 connected securely thereto and can rotate an angle smaller than 180 degrees.

Figure 3:
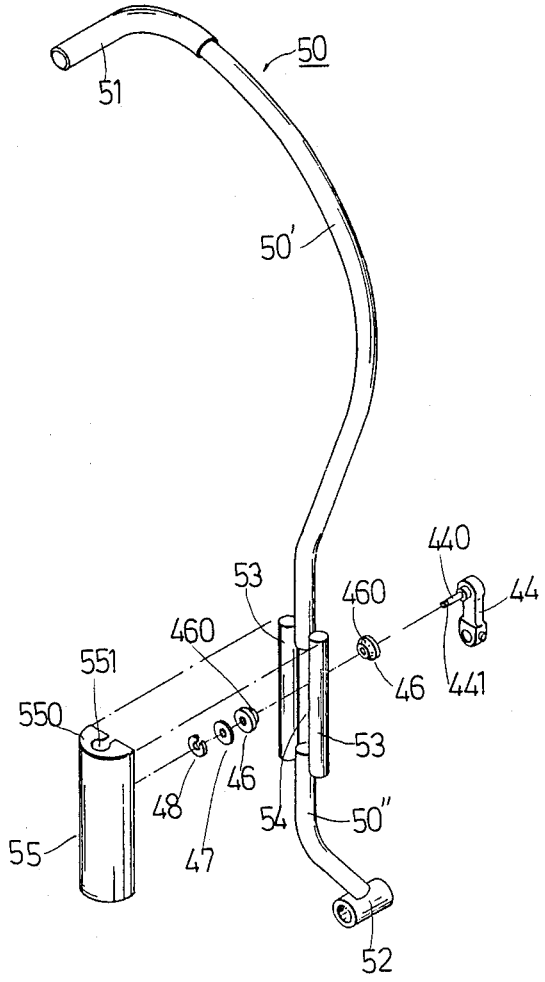
FIG. 3 is an exploded view showing the assembly of the swing lever, the crank arm, the crank pin member and the rollers of the exercise bicycle according to this invention.

Referring to FIG. 3, two butted rollers 46 are sleeved rotatably on the crank pin member 440 and have a large-diameter portion, a small-diameter portion, and a tapered shoulder 460 interconnecting the large-diameter and small-diameter portions so as to define an annular groove of a generally V-shaped cross-section between the rollers 46. The butted rollers 46 look like a sheave. To keep the rollers 46 in a quiet and smooth rolling condition, the rollers 46 are preferably made of plastic, steel or nylon. The crank pin member 440 has an annular groove 441 in the end portion thereof. A retaining ring 48 is sleeved on the crank pin member 440 and engaged with the annular groove 441 so as to retain the rollers 46 and a washer 47 on the crank pin member 440.

The swing lever assembly 50 consists of two swing levers each of which includes an upper lever portion 50', a lower lever portion 50'', a grip 51, a lower end sleeve 52 sleeved rotatably on a pivot pin 110 which is fixed on the base frame 11, and two cylindrical rods 53 interconnecting the upper lever portion 50' and the lower lever portion 50'' for defining a slide slot 54 therebetween. It is understood that no tool is needed when the rollers 46 are coupled with both the crank pin member 440 and the swing lever. The inner side portions of the rods 53 are engaged with the annular groove of the sheave or the tapered shoulders 460 of the rollers 46 so that the crank pin member 440 can slide smoothly in the slide slot 54 of the swing lever. A shield 55 is in the form of a semi-cylinder and has a top wall 550 in which a retaining groove 551 is formed. The retaining groove 551 of the shield 55 is engaged with the upper lever portion 50' of the swing lever. The bottom wall of the shield 55 is retained on the lower lever portion 50'' of the swing lever in the same manner in which the top wall 550 is retained on the upper lever portion 50'.

Figure 4:
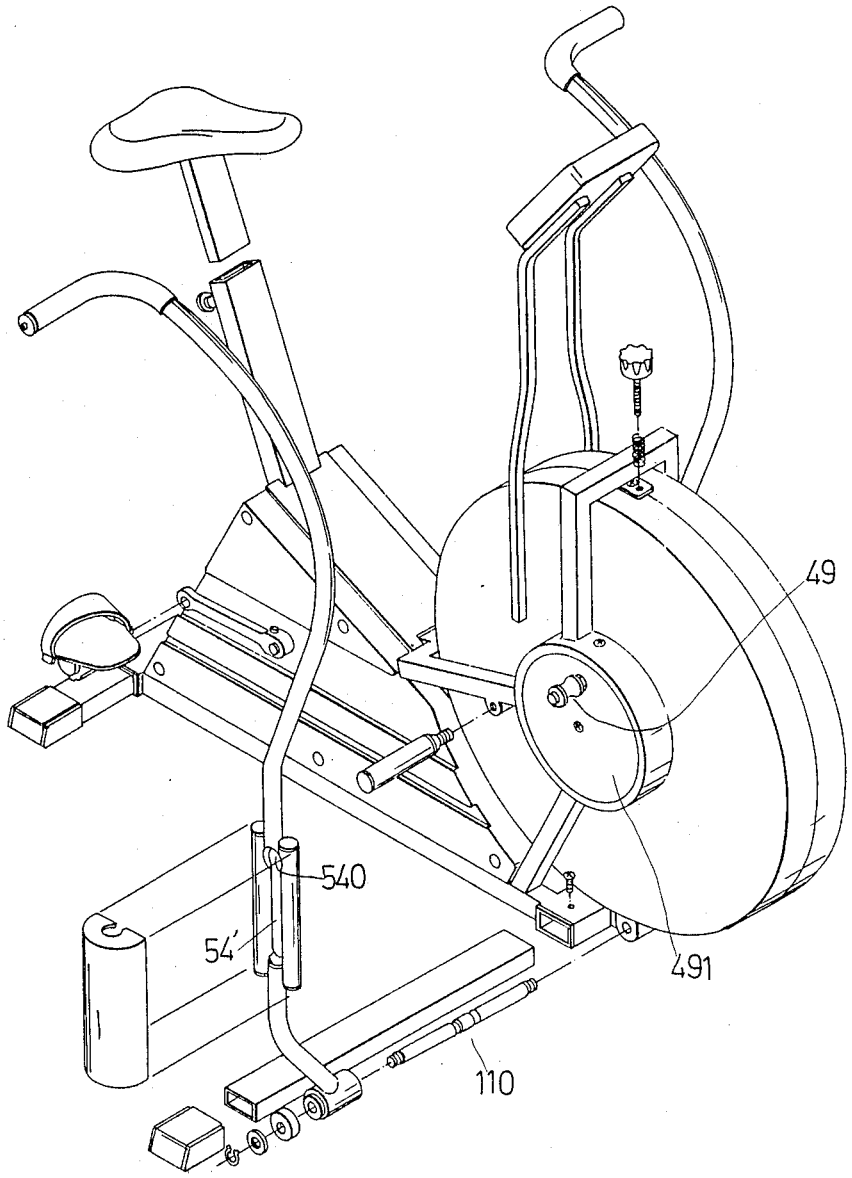
FIG. 4 is an exploded view showing a modified form of the assembly of FIG. 3 according to this invention.

Alternatively, referring to FIG. 4, the rollers 46 may be replaced with a sheave 49 which is connected pivotally on a rotating wheel 491. The slide slot 54' of the swing lever has an enlarged upper end 540 through which the sheave 49 is inserted into the slide slot 54'. It should also be stressed that, when the sheave 449 is coupled with the swing lever, no tool is needed. The sheave 49 can only slide in the slide slot 54' below the enlarged upper end 540 when the levers are swung.

The wheel assembly 60 includes a wheel hub 61, and a driven wheel 62 sleeved rigidly on the wheel hub 61. The wheel hub 61 is sleeved rotatably on the wheel axle 41 by hub bearings 63 and includes a front pulley 64 sleeved rigidly on the wheel hub 61. A v-belt 65 is engaged with the V-shaped grooves of both the rear pulley 34 and the front pulley 64. In this embodiment, to increase lifetime and reduce noise, the v-belt 65 is made of polyurethane. The driven wheel 62 is enclosed by a net shield, (not shown), in a known manner.

When the pedals 24 are propelled forward, the power is transferred to the wheel 62 through the transmission line of the crank arms 23, driving shaft 21, rear driving sprocket 22, foot driven chain 35, foot driven sprocket 32, driven shaft 31, rear pulley 34, v-belt 65, front pulley 64 and hub 61.

When the levers 51 are swung manually to and fro, the power is transferred to the wheel 62 through the transmission line of the swing arms 44, wheel axle 41, front driving sprocket 42, hand driven chain 43, hand driven sprocket 33, driven shaft 31, rear pulley 34, v-belt 65, front pulley 64 and hub 61.

With this invention thus explained, it is apparent that numerous modifications and variations can be made without departing from the scope and spirit of this invention. It is therefore intended that this invention be limited only as indicated in the appended claims.

I claim:

1. An exercise bicycle comprising:

a frame assembly including a base frame, a driven wheel frame fixed on a front portion of said base frame, and a seat frame fixed on a rear portion of said base frame;

a foot operated drive assembly including a driving shaft journalled on said seat frame, a rear driving sprocket sleeved rigidly on an intermediate portion of said driving shaft, two crank arms respectively secured to two ends of said driving shaft, and two pedals secured to said respective crank arms;

a hand operated drive assembly including a wheel axle journalled on said wheel frame, a front driving sprocket sleeved rigidly on said wheel axle, two swing arms secured to two opposite end portions of said wheel axle, and two hand operated swing levers mounted pivotally at their lower ends on said base frame, each of said levers including an upper lever portion, two parallel rods respectively secured to two sides of a lower end of said upper lever portion, and a lower lever portion secured to inner sides of lower ends of said rods so as to define a slide slot between said rods, each of said rods having an arcuated inner side portion, each of said swing arms having a crank pin member and including a sheave sleeved rotatably on said crank pin member, each of said sheaves having an annular groove of a generally V-shaped cross-section and inserted into said slide slot of corresponding said lever in such a manner that said annular groove engages with said arcuated inner side portions of said rods, so that said crank pin member can slide along said slide slot of said lever;

a driven shaft assembly including a driven shaft journalled on said base frame between said driving shaft and said wheel axle, a foot driven sprocket sleeved rotatably on said driven shaft, clutch means for locking said foot driven sprocket on said driven shaft when said foot driven sprocket rotates in a predetermined direction, a foot driven chain trained on said rear driving sprocket and said foot driven sprocket, a hand driven sprocket sleeved rotatably on said driven shaft, clutch means for locking said hand driven sprocket on said driven shaft when said hand driven sprocket rotates in a predetermined direction, a hand driven chain trained on said front driving sprocket and said hand driven sprocket, and a rear pulley sleeved rigidly on said driven shaft; and a wheel assembly including a wheel hub sleeved rotatably on said wheel axle, a wheel sleeved rigidly on said wheel hub, a front pulley sleeved rigidly on said wheel hub, and an endless belt trained on said front pulley and said rear pulley;

whereby, when said pedals are rotated in said predetermined direction, said driving shaft, rear driving sprocket, foot driven chain, foot driven sprocket, driven shaft, rear pulley, endless belt, front pulley, hub, and wheel are in turn rotated in said predetermined direction;

when said levers are swung, said wheel axle, front driving sprocket, hand driven chain, hand driven sprocket, driven shaft, rear pulley, endless belt, front pulley, hub, and wheel are in turn rotated in said predetermined direction; and when a first torque is applied to said driven shaft through said foot driven sprocket by rotating said pedals in said predetermined direction, and when a second torque is applied to said driven shaft through said hand driven sprocket by swinging said levers, the sum of said first and second torques is output through said rear pulley.

2. An exercise bicycle as claimed in claim 1, wherein each of said sheaves consists of two butted rollers sleeved rotatably on said crank pin member, and wherein each of said crank pin members has an annular groove at an end portion thereof, and a retaining ring engaged with said annular groove of said crank pin member for retaining said rollers on said crank pin member.

3. An exercise bicycle as claimed in claim 1, wherein said slide slot of each of said levers has an enlarged end of a diameter slightly greater than greatest diameter of corresponding said sheave, said sheave being slidable in said slide slot below said enlarged upper end of said slide slot, whereby, when said sheave is coupled with said lever, it can be inserted into said slide slot through said enlarged end.

4. An exercise bicycle as claimed in claim 1, wherein said belt is a v-belt.

* * * * *